US009874825B2

(12) United States Patent
Chung et al.

(10) Patent No.: US 9,874,825 B2
(45) Date of Patent: Jan. 23, 2018

(54) CONTINUOUS COALESCENCE PROCESSES

(71) Applicant: Xerox Corporation, Norwalk, CT (US)

(72) Inventors: Joo T. Chung, Webster, NY (US); Chieh-Min Cheng, Rochester, NY (US); Steven M. Malachowski, East Rochester, NY (US); Eric Joseph Young, Webster, NY (US); Eric David Godshall, Macedon, NY (US); Brian Joseph Marion, Ontario, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/464,633

(22) Filed: Mar. 21, 2017

(65) Prior Publication Data

US 2017/0192371 A1 Jul. 6, 2017

Related U.S. Application Data

(62) Division of application No. 13/856,496, filed on Apr. 4, 2013, now Pat. No. 9,639,013.

(51) Int. Cl.
*G03G 9/08* (2006.01)

(52) U.S. Cl.
CPC ..... *G03G 9/081* (2013.01); *G03G 9/0819* (2013.01); *G03G 9/0827* (2013.01)

(58) Field of Classification Search
CPC ..... G03G 9/081; G03G 9/0819; G03G 9/0821
USPC ..... 430/137.14; 366/84; 264/211.23
See application file for complete search history.

(56) References Cited

U.S. PATENT DOCUMENTS

| | | | |
|---|---|---|---|
| 7,459,259 | B2 | 12/2008 | Chung et al. |
| 7,560,505 | B2 | 7/2009 | Agur et al. |
| 8,058,335 | B2 | 11/2011 | Brick et al. |
| 8,168,699 | B2 | 5/2012 | Lincoln et al. |
| 8,207,246 | B2 | 6/2012 | Faucher et al. |
| 8,252,501 | B2 | 8/2012 | Maezawa et al. |
| 8,288,070 | B2 | 10/2012 | Mizuhata et al. |
| 8,338,071 | B2 | 12/2012 | Qiu et al. |
| 2008/0138738 | A1 | 6/2008 | Chung et al. |
| 2011/0196066 | A1 | 8/2011 | Faucher et al. |
| 2011/0286296 | A1 | 11/2011 | Chung et al. |
| 2012/0183898 | A1 | 7/2012 | Faucher et al. |
| 2014/0302432 | A1 | 10/2014 | Chung et al. |

*Primary Examiner* — Mark A Chapman
(74) *Attorney, Agent, or Firm* — Fay Sharpe LLP

(57) ABSTRACT

Processes for continuously coalescing particles from an aggregated particle slurry are disclosed. The aggregated particle slurry is heated, then coalesced by raising the pH. The coalesced particles are homogenized and exit as a coalesced particle slurry. A multi-screw extruder is used for the coalescing. These processes are useful for providing coalesced particles such as toner compositions.

20 Claims, 2 Drawing Sheets

CONTINUOUS COALESCENCE PROCESSES

CROSS-REFERENCE TO RELATED APPLICATIONS

This application is a divisional of U.S. patent application Ser. No. 13/856,496, filed Apr. 4, 2013. The disclosure of this application is hereby fully incorporated by reference herein.

BACKGROUND

The present disclosure relates to continuous emulsion/aggregation (E/A) processes for coalescing particles. These processes are useful for producing toner compositions, and can be considered to be "green" processes due to their reduced energy consumption.

Toner compositions are used with electrostatographic, electrophotographic or xerographic print or copy devices. In such devices, an imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving substrate such as paper.

Processes for forming toner compositions are known. For example, emulsion/aggregation (E/A) processes involve preparing an emulsion of toner ingredients such as a surfactant, a monomer, a colorant, and a seed resin in water. The monomer is polymerized to form a latex. The emulsion is then aggregated and coalesced to obtain a slurry of toner particles. This allows the particle size, particle shape, and size distribution to be controlled. Washing of the resulting product, and then isolating the toner particles, completes the process.

Current E/A processes are generally performed as batch processes. Batch processes for producing resins begin with a bulk polycondensation polymerization in a batch reactor at an elevated temperature. The time required for the polycondensation reaction is long due to heat transfer of the bulk material, high viscosity, and limitations on mass transfer. The resulting resin is then cooled, crushed, and milled prior to being dissolved into a solvent. The dissolved resin is then subjected to a phase inversion process where the polyester resin is dispersed in an aqueous phase to prepare polyester latexes. The solvent is then removed from the aqueous phase by a distillation method.

Batch processes generally require a long cycle time between batches. It can be difficult to control the particle size and circularity consistently between lots. Batches are made in volumes of thousands of gallons at a time. Malfunction of the control system during a batch E/A process can result in the entire batch not meeting specification and thus being considered waste. Also, batch processes are generally labor-intensive and require a great deal of equipment, inventory, and storage space due to their long cycle time. The use of solvents can also cause environmental concerns.

It would be desirable to provide coalescence processes that allow for the preparation of toner in a manner that is more efficient, takes less time, results in a consistent toner product, and reduces waste volumes.

BRIEF DESCRIPTION

The present disclosure relates to continuous processes for producing coalesced particles, such as coalesced toner particles, using a multi-screw extruder. Generally, an aggregated particle slurry enters the extruder and a coalesced particle slurry exits the extruder.

Disclosed in embodiments herein is a continuous process for coalescing particles. An aggregated particle slurry is fed into a multi-screw extruder. The aggregated particle slurry is heated to a temperature of about 70° C. to about 98° C. in a first zone of the extruder. In a second zone of the extruder, a caustic (i.e. basic) solution is added to raise the pH of the aggregated particle slurry and form a coalesced particle slurry. The particles in the coalesced particle slurry are homogenized in a third zone of the extruder. The coalesced particle slurry is then pumped from an outlet port of the multi-screw extruder.

The process may further comprise measuring the circularity of the particles in the coalesced particle slurry in the third zone and changing the residence time of the slurry within the extruder in response thereto.

The process can sometimes further comprise recycling a portion of the coalesced particle slurry from the third zone back into the second zone.

In various embodiments, the aggregated particle slurry is fed into the extruder using a positive displacement pump.

The aggregated particle slurry may have a starting pH of about 2.5 to about 7, including from about 3.0 to about 4.5. The pH of the aggregated particle slurry may be raised to a pH range of about 7.0 to about 7.9 in the second zone to coalesce the particles.

The local residence time in the first zone may be from about 0.15 minute to about 1 minute. The local residence time in the second zone may be from about 0.15 minute to about 1 minute. The local residence time in the third zone may be from about 0.15 minute to about 1 minute.

The temperature in the second zone may be about 70° C. to about 98° C. The temperature in the third zone may be about 70° C. to about 98° C. The screws in the multi-screw extruder may rotate at a speed of about 50 rpm to about 1000 rpm.

The caustic solution used in the second zone may comprise a base selected from the group consisting of ammonium hydroxide, potassium hydroxide, sodium hydroxide, sodium carbonate, sodium bicarbonate, lithium hydroxide, potassium carbonate, triethylamine, triethanolamine, pyridine and its derivatives, diphenylamine and its derivatives, poly(ethylene amine) and its derivatives, and combinations thereof.

The aggregated particle slurry may be fed into the first zone of the extruder. The multi-screw extruder may be a twin-screw extruder.

Also disclosed are a coalesced particle slurry produced by the processes disclosed herein, and coalesced particles which can be obtained by washing and drying such a coalesced particle slurry.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
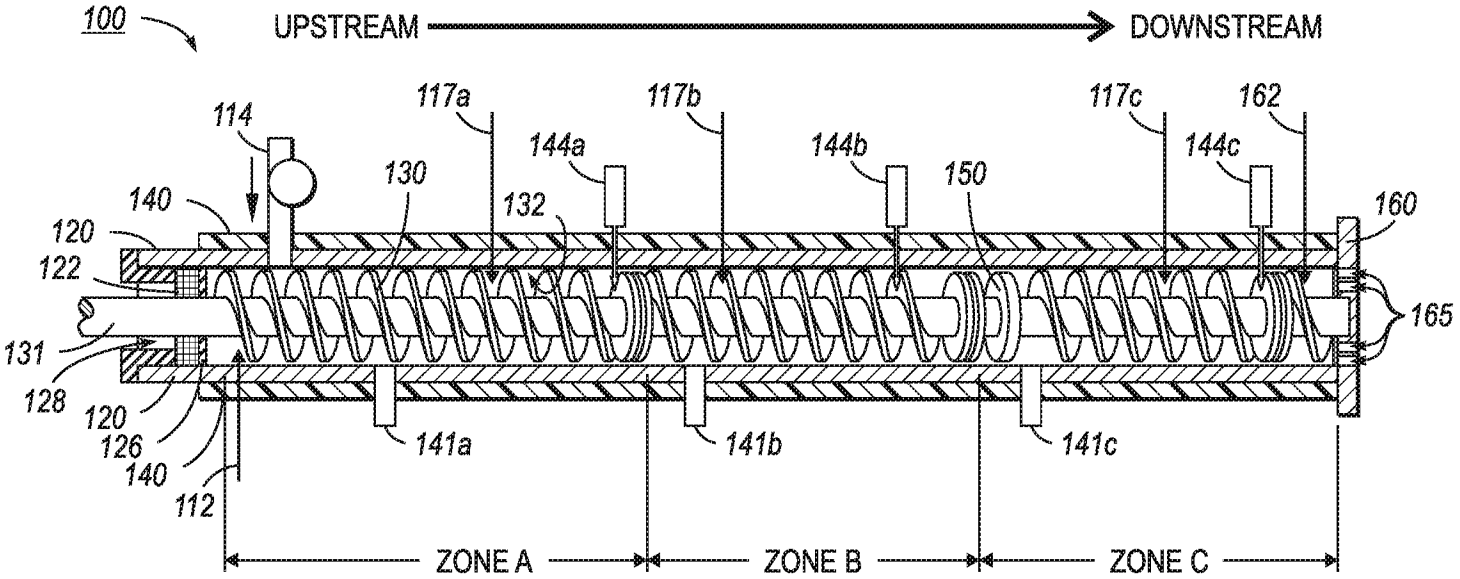
FIG. 1 is a schematic diagram showing a multi-screw extruder suitable for use in the continuous processes of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values). The endpoints of the ranges and any values disclosed herein are not limited to the precise range or value; they are sufficiently imprecise to include values approximating these ranges and/or values.

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

The continuous processes disclosed herein are used to produce coalesced particles, particularly coalesced toner compositions. Generally, an aggregated particle slurry is fed into a multi-screw extruder. The aggregated particle slurry is first heated to an operating temperature of about 70° C. to about 98° C. in a first zone of the extruder. The pH of the slurry is then raised in a second zone of the extruder to cause coalescence. The particles are homogenized in a third zone of the extruder, and then exit the extruder as a coalesced particle slurry.

The continuous process using a multi-screw extruder is simpler than producing a coalesced particle slurry using batch processes. Many process steps can be eliminated. Because the continuous process is simpler, production costs are lower. Because smaller quantities of material are processed at a time, quality control is easier. If process controls malfunction during the continuous process, a smaller quantity of non-specification material is produced that must be discarded. Lot-to-lot variation can be reduced as well due to the control of temperature and other process parameters in small segments along the length of the extruder. In contrast, the reaction vessel used in a batch process normally has a large diameter, with an impeller rotating in the center of the vessel. As a result, there are significant large inhomogeneities in process parameters between the material near the sides of the reaction vessel and the material in the center of the reaction vessel in both the axial and radial directions. This results in gradients and process differences within the vessel, including temperature gradient, shear rate gradient, the velocity profile, pumping capacity, and viscosity differences. As a result, a long time period is needed for the material in the reactor vessel to be homogenized.

The Aggregated Particle Slurry

The processes of the present disclosure begin with an aggregated particle slurry, which is fed into a multi-screw extruder, such as a twin screw extruder. The aggregated particle slurry contains aggregated particles in a solvent, typically water. The aggregated particles may include a resin (i.e. latex), an emulsifying agent (i.e. surfactant), a colorant, a wax, an aggregating agent, a coagulant, and/or additives.

Any monomer suitable for preparing a latex may be used to form the aggregated particles. Suitable monomers useful in forming the latex, and thus the resulting latex particles in the latex resin include, but are not limited to, styrenes, acrylates, methacrylates, butadienes, isoprenes, acrylic acids, methacrylic acids, acrylonitriles, mixtures thereof, and the like. Any monomer employed may be selected depending upon the particular latex polymer to be utilized. A seed resin, which includes the latex resin to be produced, may be introduced with additional monomers to form the desired latex resin during polycondensation.

In some embodiments, the latex may include at least one polymer, including from about 1 to about 20 different polymers or from about 3 to about 10 different polymers. The polymer utilized to form the latex may be a polyester resin, including the resins described in U.S. Pat. Nos. 6,593,049 and 6,756,176, the disclosures of each of which are hereby incorporated by reference in their entirety. The latex may also include a mixture of an amorphous polyester resin and a crystalline polyester resin as described in U.S. Pat. No. 6,830,860, the disclosure of which is hereby incorporated by reference in its entirety.

In some embodiments, as described above, the resin may be a polyester resin formed by the polycondensation process of reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodium 2-sulfo-1,2-ethanediol, lithium 2-sulfo-1,2-ethanediol, potassium 2-sulfo-1,2-ethanediol, sodium 2-sulfo-1,3-propanediol, lithium 2-sulfo-1,3-propanediol, potassium 2-sulfo-1,3-propanediol, mixture thereof, and the like. The aliphatic diol may be, for example, selected in an amount of from about 40 to about 60 mole percent of the resin, and the alkali sulfo-aliphatic diol may be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodium, lithium or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, from about 40 to about 60 mole percent of the resin, and the alkali sulfo-aliphatic diacid may be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), polypropylene-adipate), poly(butylene-adipate), poly(pentylele-adipate), poly(hexylene-adipate), poly(octylene-adipate), poly (ethylene-succinate), poly(propylene-succinate), poly (butylene-succinate), poly(pentylene-succinate), poly (hexylene-succinate), poly(octylene-succinate), poly (ethylene-sebacate), poly(propylene-sebacate), poly (butylene-sebacate), poly(pentylene-sebacate), poly (hexylene-sebacate), poly(octylene-sebacate), alkali copoly (5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly (octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinamide), and poly(propylene-sebecamide). Examples of polyimides include poly(ethylene-adipimide), poly(propylene-adipimide), poly(butylene-aipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 30 percent by weight of the toner components (i.e. the slurry minus the solvent), including from about 15 to about 25 percent by weight. The crystalline resin may possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 2 to about 4.

Alternatively, the polyester resin may be an amorphous polyester. Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be selected, for example, from about 40 to about 60 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected may vary, and may be, for example, from about 40 to about 60 mole percent of the resin.

Examples of other amorphous resins which may be utilized include poly(styrene-acrylate) resins, crosslinked, for example, from about 25 percent to about 70 percent, poly (styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly (styrene-butadiene) resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulf-o-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Other examples of suitable latex resins or polymers which may be produced include, but are not limited to, poly (styrene-butadiene), poly(methylstyrene-butadiene), poly(m ethyl methacrylate-butadiene), poly(ethyl methacrylate-butadiene), poly(propyl methacrylate-butadiene), poly(butyl methacrylate-butadiene), poly(m ethyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly (propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), polystyrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the disclosure of which is hereby incorporated by reference in its entirety), and branched polyester resins resulting from the reaction of dimethylterephthalate with 1,3-butanediol, 1,2-propanediol, and pentaerythritol may also be used.

The molecular weight of the latex correlates to the melt viscosity or acid value of the material. The weight average molecular weight (Mw) and molecular weight distribution (MWD) of the latex may be measured by Gel Permeation Chromatography (GPC). The molecular weight may be from about 3,000 g/mole to about 150,000 g/mole, including from about 8,000 g/mole to about 100,000 g/mole, and in more particular embodiments from about 10,000 g/mole to about 90,000 g/mole.

The resulting polyester latex may have acid groups at the terminal of the resin. Acid groups which may be present include carboxylic acids, carboxylic anhydrides, carboxylic acid salts, combinations thereof, and the like. The number of carboxylic acid groups may be controlled by adjusting the starting materials and reaction conditions to obtain a resin that possesses excellent emulsion characteristics and a resulting toner that is environmentally durable.

Those acid groups may be partially neutralized by the introduction of a neutralizing agent, in embodiments a base solution, during neutralization (which occurs prior to aggregation). Suitable bases which may be utilized for this neutralization include, but are not limited to, ammonium hydroxide, potassium hydroxide, sodium hydroxide, sodium carbonate, sodium bicarbonate, lithium hydroxide, potassium carbonate, triethyl amine, triethanolamine, pyridine and its derivatives, diphenylamine and its derivatives, poly (ethylene amine) and its derivatives, combinations thereof, and the like. After neutralization, the hydrophilicity, and thus the emulsifiability of the resin, may be improved when compared with a resin that did not undergo such neutralization process. The resulting partially neutralized melt resin may be at a pH of from about 8 to about 13, in embodiments from about 11 to about 12.

The emulsifying agent present in the aggregated particle slurry may include any surfactant suitable for use in forming a latex resin. Surfactants which may be utilized during the emulsification stage in preparing latexes with the processes of the present disclosure include anionic, cationic, and/or nonionic surfactants. Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid, combinations thereof, and the like. Other suitable anionic surfactants include, in embodiments, DOWFAX® 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, and the like, and mixtures thereof. The choice of particular surfactants or combinations thereof as well as the amounts of each to be used are within the purview of those skilled in the art.

Colorants which may be present in the aggregated particle slurry include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

The colorant may be present in the aggregated particle slurry in an amount of from about 1 to about 25 percent by weight of solids (i.e. the slurry minus solvent), in embodiments in an amount of from about 2 to about 15 percent by weight of solids.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP604™, NP608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI-60710, CI Dispersed Red 15, diazo dye identified in the Color Index as CI-26050, CI Solvent Red 19, CI 12466, also known as Pigment Red 269, CI 12516, also known as Pigment Red 185, copper tetra(octadecyl sulfonamido) phthalocyanine, x-copper phthalocyanine pigment listed in the Color Index as CI-74160, CI Pigment Blue, Anthrathrene Blue identified in the Color Index as CI-69810, Special Blue X-2137, diarylide yellow 3,3-dichlorobenzidene acetoacetanilides, a monoazo pigment identified in the Color Index as CI 12700, CI Solvent Yellow 16, CI Pigment Yellow 74, a nitrophenyl amine sulfonamide identified in the Color Index as Foron Yellow SE/GLN, CI Dispersed Yellow 33,2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

A wax may also be present in the aggregated particle slurry. Suitable waxes include, for example, submicron wax particles in the size range of from about 50 to about 500 nanometers, in embodiments of from about 100 to about 400 nanometers.

The wax may be, for example, a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, commercially available polyethylene waxes possess a molecular weight (Mw) of from about 1,000 to about 1,500, and in embodiments of from about 1,250 to about 1,400, while the commercially available polypropylene waxes have a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight of solids, and in embodiments from about 2 to about 20 percent by weight of solids.

An aggregating agent may also be present in the aggregated particle slurry. Any aggregating agent capable of causing complexation can be used/present. Both alkali earth metal or transition metal salts may be utilized as aggregating agents. In embodiments, alkali (II) salts may be selected to aggregate sodium sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

An ionic coagulant having an opposite polarity to any ionic surfactant in the latex (i.e., a counterionic coagulant) may optionally be present in the aggregated particle slurry as well. Coagulant can be used, for example, to prevent/minimize the appearance of fines in the slurry. Fines refers, in embodiments, for example, to small sized particles of less than about 6 microns in average volume diameter, in embodiments from about 2 microns to about 5 microns in average volume diameter, which fines may adversely affect toner yield. Counterionic coagulants may be organic or inorganic entities. Exemplary coagulants that may be present include polymetal halides, polymetal sulfosilicates, monovalent, divalent or multivalent salts optionally in combination with cationic surfactants, mixtures thereof, and the like. Inorganic cationic coagulants include, for example, polyaluminum chloride (PAC), polyaluminum sulfo silicate (PASS), aluminum sulfate, zinc sulfate, or magnesium sulfate. For example, the slurry may include an anionic surfactant, and the counterionic coagulant may be a polymetal halide or a polymetal sulfo silicate. When present, the coagulant is used in an amount from about 0.02 to about 2 percent by weight of solids, in embodiments from about 0.1 to about 1.5 percent by weight of solids.

The aggregated particle slurry may also include any known charge additives in amounts of from about 0.1 to about 10 weight percent, and in embodiments of from about 0.5 to about 7 weight percent of solids. Examples of such charge additives include alkyl pyridinium halides, bisulfates, negative charge enhancing additives like aluminum complexes, and the like.

Surface additives may be present in the aggregated particle slurry. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of solids. Other additives include zinc stearate and AEROSIL R972® available from Degussa. The coated silicas of U.S. Pat. Nos. 6,190,815 and 6,004,714, the disclosures of each of which are hereby incorporated by reference in their entirety, may also be present in an amount of from about 0.05 to about 5 percent, and in embodiments of from about 0.1 to about 2 percent of solids.

Prior to being processed in the multi-screw extruder, the aggregated particle slurry contains aggregated particles which have an average diameter ranging from about 3 microns (μm) to about 25 μm, or in more specific embodiments a diameter of from about 4 μm to about 15 μm. The average diameter is reported as the $D_{50}$, or the diameter at which 50% of the particles have a lower diameter and 50% of the particles have a greater diameter.

The aggregated particle slurry may have a GSDv and/or a GSDn of from about 1.05 to about 1.55. The GSDv refers to the upper geometric standard deviation (GSDv) by volume (coarse level) for ($D_{84}/D_{50}$). The GSDn refers to the geometric standard deviation (GSDn) by number (fines level) for ($D_{50}/D_{16}$). The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles.

The particles in the aggregated particle slurry may have a circularity of from about 0.93 to about 0.95. The circularity is a measure of the particles' closeness to perfectly spherical. A circularity of 1.0 identifies a particle having the shape of a perfect circular sphere. The volume average circularity may be measured though Flow Particle Image Analysis (FPIA), provided for example by the Sysmex® Flow Particle Image Analyzer, commercially available from Sysmex Corporation. The particles may also be of a core-shell construction.

The aggregated particle slurry contains from about 30 wt % to about 50 wt % of solids, and contains from about 50 wt % to about 70 wt % of solvent (typically water). The aggregated particle slurry has an acidic "starting" pH, generally between about 2.5 to 7, and in more particular embodiments from about 3.0 to about 4.5.

Continuous Coalescence Process

The continuous coalescence processes described herein transform the aggregated particle slurry into a coalesced particle slurry. In this regard, the aggregated particle slurry is a formation of clustered particles in a colloidal suspension. The aggregated particles are dispersed in the liquid phase, stick to each other, and spontaneously form irregular particle clusters by pH and shear induced electro-static charges. The boundaries of individual particles are still present within the clusters at this stage. The coalescence process unites the aggregated particles to form one mass, or in other words the boundaries of the smaller aggregated particles are not present in a coalesced particle.

The continuous coalescence processes of the present disclosure begin with feeding the aggregated particle slurry into a multi-screw extruder. A multi-screw extruder includes a segmented barrel and at least two screw elements extending lengthwise through the barrel. Each segment of the barrel can be heated and controlled at a set temperature independently of the other barrel segments, and functions as a continuous small reaction vessel or reactor. The screw elements in each segment can also be varied for the particular application. The local residence time in each segment can be lengthened or shortened, the mixing intensity can be adjusted, and the shear stress and shear rate profiles can be optimized through screw design. The local pressure and volume can also be changed within each segment of the barrel through screw design. The screw speed and particle slurry feed rate can be controlled during the continuous process. Such an extruder permits many different applications, such as melt-mix, distributive mixing, dispersive mixing, dissipative missing, and chaotic mixing.

Referring now to FIG. 1, the multi-screw extruder 100 includes an extruder barrel 120, at least two screws 130, a screw extruder channel 132, a heater 140, thermocouple 141, a solvent supply port 112; and a slurry supply port 114. Each screw 130 is driven by a shaft 131 which is connected to a drive motor (not shown) in a conventional manner that allows for rotation of screw 130 at speeds of from about 50 rotations per minute ("rpm") to about 1000 rpm, or in more specific embodiments from about 250 rpm to about 750 rpm. Each shaft 131 passes through liquid seal housing 128, blister ring 122, and seal pack 126, which seals the upstream end of barrel 120.

The screw extruder 100 is divided into three zones; namely Zone A (first zone) where the aggregated particle slurry is heated, Zone B (second zone) where coalescence takes place, and Zone C (third zone) where particle homogenization takes place. Zone A is upstream of Zone B, which is upstream of Zone C. As previously mentioned, the barrel is separated into segments; each zone includes at least one segment, and may include a plurality of segments. Each zone includes a thermocouple 141*a*, 141*b*, 141*c* for monitoring and controlling the temperature of the zone; a pH meter 144*a*, 144*b*, 144*c* for monitoring the pH of the zone; and a pH titration agent supply port 117*a*, 117*b*, 117*c* for changing the pH in the zone as needed. Material moves from the upstream end of the extruder 100 in the downstream direction sequentially through Zones A, B and C, eventually exiting the extruder 100 through openings 165 of head 160. The solvent supply port 112 and a slurry supply port 114 are located in Zone A.

Each screw 130 can be modular in construction in the form of pieces of conveying elements, enabling the screw to be configured with different conveying elements and kneading elements having the appropriate lengths, pitch angles, and the like, in such a way as to provide optimum conveying, mixing, dispersing, devolatilizing, discharging, and pumping conditions. For example, each conveying element may have a length of from about 1350 mm to about 3000 mm, and a pitch angle of from about 0° to about 90°. In more particular embodiments, each conveying element has a length from about 1500 mm to about 2500 mm, and a pitch angle of from about 20° to about 75°. Kneading elements may be affixed to the screw, or the kneading elements may be integral thereto and project therefrom. Kneading elements may have any suitable shape, size, and configuration, including right and left hand kneading elements and neutral kneading elements with the helix angle of the kneading elements being from about 45° to about 90°, combinations thereof, and the like. The kneading elements may be forward, neutral, and/or reverse kneading elements. Put another way, they may push the particles through the extruder toward the outlet port (forward), back through the extruder toward the inlet port (reverse), or they may knead the aggregated/coalesced particles without actively forwarding or reversing the components through the extruder (neutral).

Figure 2:
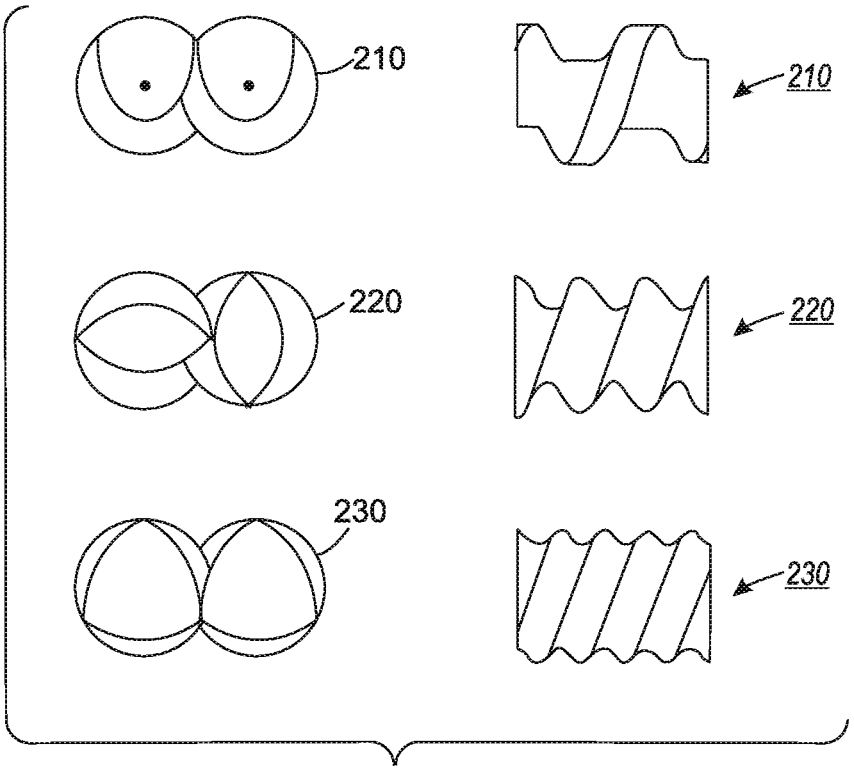
FIG. 2 provides axial and profile views illustrating the differences between single-lobe, two-lobe, and three-lobe screws.

FIG. 2 provides a axial view (on the left) and a profile view (on the right) for three different types of conveying/kneading elements that can be used in a multi-screw extruder. Illustrated here are a single lobe screw 210, a two-lobe screw 220, and a three-lobe screw 230. As the number of lobes increases, the element generates higher shear and shear stress, as well as increasing residence time of the material in the system for a given screw speed and set of process conditions. A three-lobe screw generates higher viscous dissipation heat due to high shear stress and shear rate, and is more effective for a dissipative melt mixing in the segment in which it is used. A three-lobe screw has less free volume and results in lower throughput, which in turn, lowers productivity compared to a two-lobe screw. Thus, a two-lobe screw has higher free volume and increases productivity. A two-lobe screw may also effectively be used as an equivalent to the three-lobe screw by changing the process conditions without jeopardizing productivity.

The local residence time in each of Zones A, B and C can be controlled by screw design, screw speed, feed rates, temperature and pressure. The local residence time suitable for the continuous coalescence processes will vary depending on a number of factors including, for example, the particular latex employed, the temperature within the zone, the length of the zone, etc. The screw extruder should be designed to provide local residence times of about 0.15 minutes to about 1 minute in Zone A; about 0.15 minutes to about 1 minute in Zone B; and about 0.15 minutes to about 1 minute in Zone C. In embodiments, the total residence time of the slurry within the multi-screw extruder is from about 0.5 minutes to about 2 minutes.

Initially, the aggregated particle slurry is fed into the barrel 120 of the extruder via the slurry supply port 114. The aggregated particle slurry can be pumped into the barrel at a controlled volumetric rate of 1 to 20 kg/hour, or at a pressure of from about 5.0 psi to about 100 psi. If needed, additional solvent (e.g. water) can be added through the solvent supply port 112. Again, the aggregated particle slurry has an acidic "starting" pH, generally between about 3.0 and about 4.5.

When being fed into the barrel, the aggregated particle slurry generally is at a temperature of from about 20° C. to about 50° C. Once fed into Zone A, the aggregated particle slurry is heated to a higher temperature in the range of about 70° C. to about 98° C., or in more specific embodiments about 80° C. to about 90° C. The aggregated particle slurry then moves into Zone B.

In Zone B, a caustic solution is injected into the slurry via pH titration agent supply port 117*b* to raise the pH to a range of from about 3.0 to about 7.9, or from about 7.0 to about 7.9. Suitable bases for the caustic solution include, but are not limited to, ammonium hydroxide, potassium hydroxide, sodium hydroxide, sodium carbonate, sodium bicarbonate, lithium hydroxide, potassium carbonate, triethyl amine, triethanolamine, pyridine and its derivatives, diphenylamine and its derivatives, poly(ethylene amine) and its derivatives, combinations thereof, and the like. The elevated temperature is also maintained in Zone B.

Coalescence occurs by kneading the aggregated particle slurry at the elevated temperature and the raised pH. The coalesced particles are processed to arrive at a coalesced particle slurry having a desired particle size distribution, as measured using the geometric standard deviation (GSD), and having a high degree of circularity.

The screws of the extruder can be configured to have right hand and neutral kneading elements. A left hand kneading element can be placed at the downstream end of the coalescence Zone B to increase local residence time.

A coalesced particle slurry exits Zone B and flows into Zone C. In Zone C, the particles are homogenized. The term "homogenizing" is used to generally refer to the process of ensuring that particles are consistently dispersed or suspended throughout a liquid. Zone C can be maintained at the same pH range as Zone B. The temperature in Zone C can be maintained at the same range as in Zone B.

The downstream end of Zone C includes a real-time particle circularity measuring device 162 which measures the circularity of the coalesced particles in this segment of the barrel. This information can be used to adjust the processing conditions in the zones of the extruder to obtain the desired final circularity, GSDn, and/or GSDv of the aggregated particles. For example, the residence time of particles in Zone B or Zone C could be increased, or the pH in Zone B could be changed.

The coalesced particle slurry is then pumped from Zone C of the screw extruder and exits the extruder through the openings 165 at the head 160 of the extruder. A positive displacement pump, such as a gear pump, can be used for this purpose to control the pump rate and regulate the back pressure.

The coalesced particle slurry contains coalesced particles which have an average diameter ranging from about 3 microns (μm) to about 25 μm, or in more specific embodiments a diameter of from about 4 μm to about 15 μm. The coalesced particle slurry may have a GSDv and/or a GSDn of from about 1.05 to about 1.55. The particles in the coalesced particle slurry may have a circularity of from about 0.96 to 1.0. The coalesced particle slurry contains from about 30 wt % to about 50 wt % of solids, and contains from about 50 wt % to about 70 wt % of solvent (typically water). The coalesced particle slurry has a pH of from about 3.0 to about 7.9, and in specific embodiments from about 7.0 to about 7.9.

The continuous coalescence processes of the present disclosure minimize vulnerability of the process to control system malfunctions and reduce the amount of wasted slurry. If a malfunction occurs, only a small amount of slurry must be discarded, rather than thousands of gallons as in batch processes. Only the bad slurry needs to be purged. The extruder can be easily cleaned, and the rest of the system can continue. This results in decreased cycle time, increased productivity, and reduced cost. Consistency between production lots is also increased. The process is less labor-intensive and uses less equipment. The coalesced particle slurry can be produced in a just-in-time manner, which minimizes inventory and storage space as well. In addition, the continuous processes disclosed herein are volumetrically more efficient than a batch process, requiring a smaller operating footprint for an equivalent operating rate.

The following examples are for purposes of further illustrating the present disclosure. The examples are merely illustrative and are not intended to limit the disclosure to the materials, conditions, or process parameters set forth therein.

EXAMPLE

A continuous coalescence process using a twin-screw extruder was used to produce two samples. In each sample, the aggregated particle slurry was pumped into the extruder at a rate of 7.5 kg/hr. The temperature of the extruder was set to 85° C.

As a Comparative Example, a batch process was used. Table 1 lists the results of the two samples and the Comparative Example. The particle sizes ($D_{50}$), GSDv, GSDn, and circularity of the two samples were almost identical to the Comparative Example.

TABLE 1

| | Aggregated Particles (Input) | | | | Coalesced Particles (Output) | | | |
|---|---|---|---|---|---|---|---|---|
| | D50 | GSDv | GSDn | Circularity | D50 | GSDv | GSDn | Circularity |
| Sample 1 | 6.81 | 1.191 | 1.248 | 0.937 | 6.56 | 1.204 | 1.239 | 0.972 |
| Sample 2 | 6.56 | 1.204 | 1.239 | 0.937 | 6.41 | 1.19 | 1.241 | 0.967 |
| Comp. Ex. | 6.8 | 1.198 | 1.222 | | 6.657 | 1.2 | 1.241 | 0.977 |

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. Coalesced particles useful for producing toner compositions, wherein the coalesced particles are produced by a continuous process comprising:

(a) feeding an aggregated particle slurry into a multi-zone extruder for a predetermined residence time;

(b) heating the aggregated particle slurry to a temperature of from about 70° C. to about 98° C. in a first zone of the multi-zone extruder;

(c) adding a caustic solution to raise the pH of the aggregated particle slurry and form a coalesced particle slurry in a second zone of the multi-zone extruder downstream of the first zone;

(d) homogenizing the particles in the coalesced particle slurry in a third zone of the multi-zone extruder downstream of the second zone;

(e) measuring circularity of the particles in the coalesced particle slurry and changing the residence time within the multi-zone extruder until the circularity of the particles in the coalesced particle slurry are of a predetermined value; and (f) removing the coalesced particle slurry of the predetermined particle circularity from an outlet port of the multi-zone extruder, wherein the particle circularity enables the coalesced particles to be useful for producing toner compositions.

2. The coalesced particles of claim 1, wherein the aggregated particle slurry of step (a) contains from about 30 weight percent (wt.-%) to about 50 wt.-% solids, and from 50 wt.-% to about 70 wt.-% of a solvent.

3. The coalesced particles of claim 2, wherein the solvent is water.

4. The coalesced particles of claim 1, wherein the aggregated particle slurry of step (a) has an acidic pH.

5. The coalesced particles of claim 4, wherein the particle slurry of step (a) has a pH of about 3.0 to 4.5.

6. The coalesced particles of claim 4, wherein an effective amount of caustic solution is added to the aggregated particle slurry of step (c), for changing its pH from acidic to a value of from about 7.0 to 7.9.

7. The coalesced particles of claim 1, wherein the aggregated particles of step (a) have an average diameter ranging from about 3 microns to about 25 microns.

8. The coalesced particles of claim 1, wherein the aggregated particle slurry of step (a) has a GSDv value ranging from about 1.05 to about 1.55.

9. The coalesced particles of claim 1, wherein the aggregated particle slurry of step (a) has a GSDn value ranging from about 1.05 to about 1.55.

10. The coalesced particles of claim 1, wherein the aggregated particle slurry of step (a) has a temperature ranging from about 20° C. to about 50° C.

11. The coalesced particles of claim 1, wherein the particles in the aggregated particle slurry of step (b) have a circularity ranging from about 0.93 to about 0.95.

12. The coalesced particles of claim 1, wherein the aggregated particle slurry of step (b) is heated to a temperature ranging from about 80° C. to about 90° C.

13. The coalesced particles of claim 1, wherein the particles in the aggregated particle slurry of step (f) have a circularity ranging from about 0.96 to about 1.0.

14. The coalesced particles of claim 1, wherein the aggregated particles of step (a) have an average diameter ranging from about 4 microns to about 14 microns.

15. The coalesced particles of claim 1, wherein the aggregated particle slurry comprises an aggregating agent, a resin, an emulsifying agent, a colorant, a wax, a coagulant, a charge additive, and a surface additive.

16. The coalesced particles of claim 15, wherein the wax particles range in size of from about 50 nanometers to about 500 nanometers.

17. The coalesced particles of claim 15, wherein the wax particles range in size of from about 100 nanometers to about 400 nanometers.

18. The coalesced particles of claim 15, wherein the aggregated particle slurry contains from about 1 wt.-% to about 30 wt.-% of solids.

19. The coalesced particles of claim 15, wherein the aggregated particle slurry contains from about 2 wt.-% to about 20 wt.-% of solids.

20. The coalesced particles of claim 15, wherein the aggregating agent comprises a surfactant.

* * * * *